United States Patent [19]

Nishiyama

[11] Patent Number: 5,024,813

[45] Date of Patent: Jun. 18, 1991

[54] MAGNESIUM-TITANIUM TYPE ALLOY AND METHOD FOR PRODUCING THE SAME

[76] Inventor: Katsuhiro Nishiyama, 1-89 Edogawadai-Higashi, Nagareyama-shi, Chiba, Japan

[21] Appl. No.: 368,286

[22] Filed: Jun. 19, 1989

[30] Foreign Application Priority Data

Nov. 8, 1988 [JP] Japan ..... 63-282182

[51] Int. Cl.[5] ..... C22C 1/04; C22C 1/65; C22C 14/00; C22C 23/00

[52] U.S. Cl. ..... 420/402; 75/245; 75/249; 419/38; 419/39; 419/47; 420/417

[58] Field of Search ..... 420/402, 417; 75/245, 75/249; 419/38, 39, 47

[56] References Cited

U.S. PATENT DOCUMENTS 3,950,166 4/1976 Obara et al. ..... 419/46

FOREIGN PATENT DOCUMENTS 2216360 8/1974 France .
40-7648 4/1965 Japan .
50-27706 3/1975 Japan .
50-116308 9/1975 Japan .
53-62728 6/1978 Japan .
1407863 9/1975 United Kingdom .

OTHER PUBLICATIONS

Ivanova et al., "Magnesium Mechanical Alloys for Hydrogen Storage" Journal of the Less Common Metals, vol. 131, 1987, pp. 25-29.

Oriani et al., "Exploratory Experiment on Feasbility of Making a Ti-Mg . . . " Trans. Metall. Society AIME, vol. 236, Oct. 1986, pp. 1508-1509.

Frantsevich et al., "Technology of Preparation and Properties of Titanium-magnesium pseudoalloys" Chemical Ab. #87(8):56862w.

Antonova et al. (1 and 2) "Hydriding of titanium-magnesium pseudoalloys" Metals Abs. 87-540608 and Chem. Abs. 105(10):83543q.

Sundaresan et al. (1) "Study of the Formation of the Amorphous phase in Metallic Systems of Mechanical Alloying" Metals Abstract #88-541064.

Sundaresan et al. (2)"Mechanical Alloying in the Titanium-Magnesium System", Metals Abstracts 89-540552.

*Primary Examiner*—R. Dean
*Assistant Examiner*—David W. Schumaker

[57] ABSTRACT

A Mg-Ti type alloy comprises 0.04 to 99.96% by weight of Ti and 99.96 to 0.04% by weight of Mg. The Mg-Ti type alloy is produced by compounding and mixing at least one of a powder of Ti and a powder of titanium hybride with a powder of Mg, so that the Ti composition in a sintered product may be in a range of 0.04 to 99.96% by weight; forming the resulting mixture into a predetermined shape, and sintering the formed material at a temperature in a range of from a solid phase point of Mg to a liquid phase point.

3 Claims, 9 Drawing Sheets

Mg SIMPLE

Mg-Ti (10% BY WEIGHT) TYPE ALLOY

Mg-Ti (20% BY WEIGHT) TYPE ALLOY

Mg-Ti (50% BY WEIGHT) TYPE ALLOY

Mg-Ti (80% BY WEIGHT) TYPE ALLOY

Mg-Ti (90% BY WEIGHT) TYPE ALLOY

Mg-Ti (7% BY WEIGHT) TYPE ALLOY, 645°C

Mg-Ti (7% BY WEIGHT) TYPE ALLOY, 657°C

Mg-Ti (7% BY WEIGHT) TYPE ALLOY, 660°C

MAGNESIUM-TITANIUM TYPE ALLOY AND METHOD FOR PRODUCING THE SAME

FIELD OF THE INVENTION

The present invention relates to a magnesium-titanium type alloy (which will be referred to as a Mg-Ti type alloy hereinafter) and a method for producing the same.

BACKGROUND OF THE INVENTION

In general, Mg-based alloys consisting essentially of Mg have been produced in a solubilization process using alloy elements such as Al, Zn and the like which have a larger solubility to Mg. These alloys include Mg-Al-Zn type alloys. Such Mg-based alloys are excellent in specific strength and vibration absorbing capacity (damping capacity), but poor in corrosion resistance.

Therefore, development of various Mg-based alloys has recently been made in order to provide a Mg-based alloy having a high strength and an excellent corrosion resistance.

It is generally difficult to produce a Mg-based alloy containing a relatively large content of an alloy element having a small solubility to Mg.

More recently, a Mg-Zr-Zn type alloy and a Mg-Zr-rare earth element type alloy have been developed by partially overcoming this difficulty. They can be produced by utilizing the fact that Mg-Zr based alloys belong to a group of alloys resulting from a peritectic reaction.

In practice, however, the Mg-Zr type alloys containing a large content of Zr have still been very difficult to produce in a solubilization process.

Accordingly, it is further desired to develop a Mg-based alloy which can be readily produced using other alloy elements in place of Zr and the like and which is excellent in properties. Ti has been regarded as an alloy element satisfying such a demand. Thus, attempts have been made to produce a Mg-Ti based alloy, because Ti belongs to the same Periodic group as Zr.

However, Ti is an element having a small solubility to Mg, and alloys containing Ti at a concentration of up to merely 0.125% by weight are shown in the phase diagrams for Mg-Ti based alloys reported by Hansen. These phase diagrams are not for the practical alloys, but have been only drawn by estimation lines, because the solubility of Ti to Mg is extremely small. Therefore, a definite phase diagram has been still not cleared. In these phase diagrams, the solubility of Ti to Mg is shown to be extremely small, i.e., 0.0025% by weight (0.0013 atom %) at 651° C. immediately above the melting point (650° C.) of Mg and 0.015% by weight at 850° C.

Thus, up to date, it has been impossible to produce a Mg-Ti based alloy containing Ti of a high concentration, and in practice, no Mg-Ti based alloy containing Ti of a high concentration has been produced.

It is required on all accounts and desired to develop a Mg-Ti type alloy and a method for production thereof, because the Mg-Ti type alloy is regarded as an alloy providing an effect similar to that of the Mg-Zn type alloy and thus, having a high strength, a high damping capacity and the like.

BRIEF SUMMARY OF THE INVENTION

The present invention has been accomplished with such circumstances in view, and it is an object of the present invention to provide a Mg-Ti based alloy which is excellent in strength, corrosion and wear resistances and damping capacity, lightweight and has easy forming and processing properties and which is easy to produce.

It is another object of the present invention to provide a process for producing such a Mg-Ti based alloy.

To attain the above objects, according to the present invention, there is provided a Mg-Ti based alloy comprising 0.04 to 99.96% by weight of Ti and 99.96 to 0.04% by weight of Mg.

In addition, there is provided a process for producing such a Mg-Ti based alloy, comprising the steps of compounding and mixing at least one of a powder of Ti and a powder of titanium hydride (which will be referred to as a powder of $TiH_2$ which is a general term including titanium hydrides other than that having a ratio of Ti to H of 1:2) with a powder of Mg, so that the Ti amount in a sintered product or sinter may be in a range of 0.04 to 99.96% by weight, forming the resulting mixture into a predetermined shape, and sintering the formed material at a temperature in a range of from a solid phase point of Mg to a liquid phase point.

According to the present invention, there is further provided a process for producing such a Mg-Ti based alloy, comprising the steps of compounding and mixing at least one of a powder of Ti and a powder of $TiH_2$ with a powder of Mg, so that the Ti composition in the final product may be in a range of 0.04 to 99.96% by weight, transferring the resulting mixture along a transfer path while heating and pressurizing it to melt Mg, pouring the molten mixture containing at least one of the Ti powder and the $TiH_2$ powder incorporated in the molten Mg into a forming mold, and cooling the mixture.

As described above, the Mg-Ti type alloy of the present invention has a concentration of Ti of 0.04 to 99.96% by weight and hence, is of an extremely high concentration, as compared with that of the conventional Mg-Ti alloy.

Accordingly, the Mg-Ti type alloy of the present invention is excellent in strengths such as bending strength and tensile strength, corrosion and wear resistances and damping capacity, and is lightweight and has advantageous forming and processing properties.

In addition, the process of the present invention makes it possible to readily produce a Mg-Ti type alloy in a usual sintering manner by mixing at least one of a powder of Ti and a powder of $TiH_2$ with a powder of Mg, so that the Ti composition in the resulting sintered product may be in a range of 0.04 to 99.96% by weight, forming the mixture into a predetermined shape, and sintering it at a temperature in a range of from the solid phase point of Mg to the liquid phase point.

Further, the other process of the present invention also makes it possible to produce a Mg-Ti type alloy having extremely excellent properties while forming it into any shape by mixing at least one of a powder of Ti and a powder of $TiH_2$ with a power of Mg, so that the Ti composition in the final product may be in a range of 0.04 to 99.96% by weight, transferring the resulting mixture along a transfer path while heating and pressurizing it to melt Mg, pouring the molten mixture containing at least one of the Ti powder and the $TiH_2$ powder incorporated in the molten Mg into a forming mold, and cooling the mixture.

As described above, according to the present invention, it is possible to readily provide a Mg-Ti type alloy containing Ti in a content as large as 0.04 to 99.96% by weight, which has been not produced in the conventional solubilization process, by use of the conventional producing technique such as non-pressurized or pressurized sintering in solid and liquid phases. The usual forming process can be also used to achieve the forming into any shape. Further, there is provided a Mg-Ti type alloy which is excellent in strength, damping capacity, corrosion and wear resistances and machinability, as compared with the prior art alloys produced in the solubilization process.

Because of its strength, wear resistance and high damping capacity superior to those of the prior art alloy produced in the solubilization process, and of its lightness similar to that of the prior art alloy, the Mg-Ti type alloy of the present invention can be used as a structural Mg-based alloy for a cover, a frame, a vibration-absorbing frame, engine block and parts for an automobile as well as a Mg-based alloy for mechanical components such as a blade or vane of a vane pump and various valves, and also can be impregnated with an oil or a solid lubricating material by utilizing its porosity to form a bearing and can be applied as a blank for producing a precision worked product by utilizing its easy machinability. In addition, the process for production thereof is simpler than that for the prior art alloy, and it is possible to prepare a Mg-Ti alloy powder such as a Mg-Al-Zn, Mg-Zr-Zn or Mg-Zr-rare earth element type alloy having a composition which can be produced in the conventional solubilizing process, and readily produce a Mg-Ti type alloy including it as a substrate, leading to a wider range of application than that of the prior art alloy. Further, it is possible to make a material comprising a Mg-Ti type alloy as a base component and excellent in strength and resistances to heat, oxidation, corrosion and wear, such as a wear-resistant fiber-reinforced composite material, leading to an extremely large industrial effect.

DETAILED DESCRIPTION OF THE EMBODIMENTS

Figure 1:
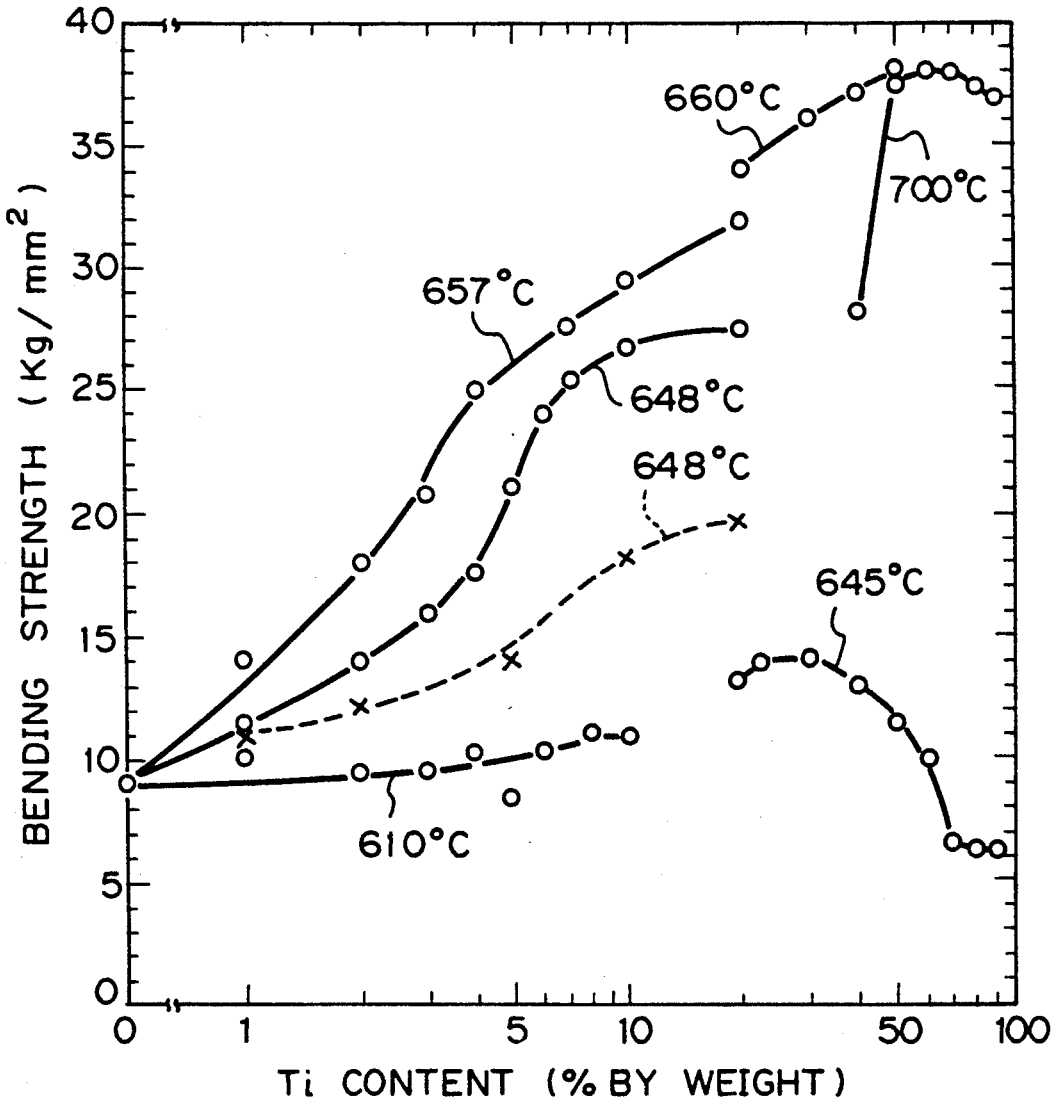
FIG. 1 is a graph illustrating a relationship between the Ti concentration and the bending strength of a Mg-Ti type alloy produced by a sintering process of the present invention.

First, a process will now be described for producing a Mg-Ti type alloy in a sintering manner.

A powder of Mg, a powder of Ti and/or a powder of $TiH_2$ are first prepared.

In this case, the Mg powder used may be of a size such that it passes through 80 meshes, while the Ti and $TiH_2$ powders used may be of a size such that they pass through 200 meshes.

Then, at least one of the Ti and $TiH_2$ powders is compounded with the Mg powder so that the Ti amount in the resulting sintered product may be in a range of 0.04 to 99.96% by weight.

The compounded material from the Mg powder and the Ti and $TiH_2$ powders is mixed in a dry manner in air or in an inert gas atmosphere, or in a wet manner using a solvent such as toluene. Such mixing may be conducted using a mixer such as a pestle or a ball mill.

Thereafter, the resulting mixture is formed into a predetermined shape. If a compression molding process utilizing a pressing with a pressure of 0.1 to 5 tons/cm$^2$ is employed for such forming, the mixture can be satisfactorily formed into a predetermined shape.

Then, the formed material is sintered.

The sintering temperature may be a level lower than the melting point (650° C.) of Mg but such that the solid phase sintering can be achieved, or a level higher than the melting point of Mg but such that the liquid phase sintering can be achieved. According to the present invention, the desirable range of temperature is of about 250° to 800° C.

The condition within a sintering furnace may be of an inert gas atmosphere such as nitrogen, argon and sulphur hexafluoride gases, or in vacuum.

The sintering pressure may be in a wider range of 0 to 600 kg/cm$^2$. Specifically, it can be a vacuum condition created by evacuation, a non-pressurized condition such as in a depressurized gas, under the atmospheric pressure and in a pressurized gas, and a pressurized condition.

The heating retension time may be of about 10 to 60 minutes.

The cooling may be slow or rapid. Alternatively, the mixture may be rapidly cooled in a predetermined vacuum down to a temperature lower than the melting point of Mg at such degree of vacuum (e.g., 380° C.: $10^{-3}$ torr), e.g., to a point within a range of temperatures decreased by about 100° to 300° C. from such melting point; maintained at that temperature for a predetermined period of time and then, rapidly cooled again.

The nature of the Mg-Ti type alloy produced in this manner by a sintering process will be described below in connection with the above process conditions.

A Mg-Ti (of 0.04 to 99.96% by weight) type alloy may be produced even if a material mixed with the Mg powder is either of the Ti powder and the $TiH_2$ powder.

The Mg-Ti type alloy has properties such as high mechanical strengths such as bending strength, tensile strength and the like and has an excellent corrosion resistance such that it cannot be rusted at all, even if it is immersed in saline water so that it may be forcedly rusted. Additionally, it has a high wear resistance and damping capacity and is lightweight. Further, it is excellent in machinability and workability. In addition, the sintered product or sinter could be subjected to a hot or cold forging and mechanically cut with a very small aperture to provide a worked product such as a gear having an excellent strength.

A further detailed review has showed that the use of the $TiH_2$ powder produces a higher strength sintered product, a compared with the use of the Ti powder.

This is by the following reason: $TiH_2$ is decomposed during sintering due to the sintering temperature, and hydrogen produced from such decomposition promotes the sintering between Mg particles. In this case, there is a possibility of production of $MgH_2$ during cooling, but this $MgH_2$ is repeatedly produced and decomposed during cooling and eventually, hydrogen is removed in the form of water ($H_2O$) out of the sintered product.

It has been further found that such $MgH_2$ is decomposed into Mg and $H_2$, and $H_2$ gas is completely removed off in a special cooling method, for example, if the mixture is rapidly cooled in vacuum of $10^{-3}$ torr down to about 100 to 350° C. lower than the melting point of Mg of 380° C. at $10^{-3}$ torr, and then maintained at the same temperature for a predetermined period of time (10 to 30 minutes). However, the removal of $MgH_2$ is satisfactorily effected during a usual cooling step, even if such a special vacuum cooling method is not adopted. It is also possible to prevent the wastage of the sintering mold without exposure thereof to an excessively increased temperature by combination of this special cooling method with the sintering at a decreased temperature.

As a result of investigation about the relationship with the particle size of the Mg powder as a substrate of −80/+100, −10/+150, −150/+200, −200/+250, −250/+325, −325, −100 and −200 meshes, it has been found that the sinter density little depends upon the particle size of the Mg powder. The bending strength is increased by about 10% as the particle size of the Mg powder is smaller. Particularly, the use of a Mg powder of −200 meshes results in a folding endurance increased by about 20%, as compared with the use of a Mg powder of −100 meshes.

Description will now be made of the nature of the Mg-Ti type alloy due to variation of the concentration of Ti based on Mg.

With a sintering method under ambient pressure, the relative density of the sintered product is reduced, whereas the bending strength is increased, as the concentration is increased. This is an effect which has been not observed in all the prior art sintered alloys.

In a hot press sintering method, the relative density is 100% in all cases even if the concentration of Ti is varied, and the bending strength tends to increase.

The following is the description of a relationship between the condition within the sintering furnace and the sintered product.

A porous sintered product is produced when sintering is conducted in vacuum rather than when sintering is conducted in an inert atomosphere such as nitrogen, argon, sulphur hexafluoride and the like. By impregnating the sintered product with an oil or a solid lubricant by utilizing its porosity, the product can be employed as a bearing alloy.

The effect provided by the sintering pressure has been previously described in the aforesaid paragraphs of the vacuum method, the ambient-pressure method, and the hot press method and hence, is omitted herein.

Description will be made of an effect provided by the sintering time.

The experiments using the sintering times of 6 to 120 minutes have showed that both of the sinter density and the bending strength have been less varied. Accordingly, the sintering time of 6 to 10 minutes is enough.

The present invention will be described below by way of specified examples.

EXAMPLE 1

20 Samples of Mg-Ti type alloys were made by adding a powder of Ti or a powder of $TiH_2$ having a particle size capable of passing through 325 meshes to a powder of Mg having a particle size capable of passing through 200 meshes, so that the Ti component in the Mg-Ti type alloy obtained after sintering may be of 0.1%, 1%, 2%, 3%, 4%, 5%. 6%, 7%, 8%, 10%, 20%, 22%, 30%, 40%, 50%, 60%, 70%, 80%, 90% and 95% by weight. After compression molding of the mixture of powders resulting from mixing to provide the given proportions (% by weight) under a pressure of 3 tons/cm$^2$ in a mold, the sintering thereof was conducted in an argon atmosphere under conditions of a sintering pressure of ambient level (atmospheric pressure), a sintering time of 10 minutes and a sintering temperature of solid phase sintering points of 610° C., 645° C., and 648° C. as well as liquid phase sintering points of 657° C., 660° C. and 700° C.

Figure 2:
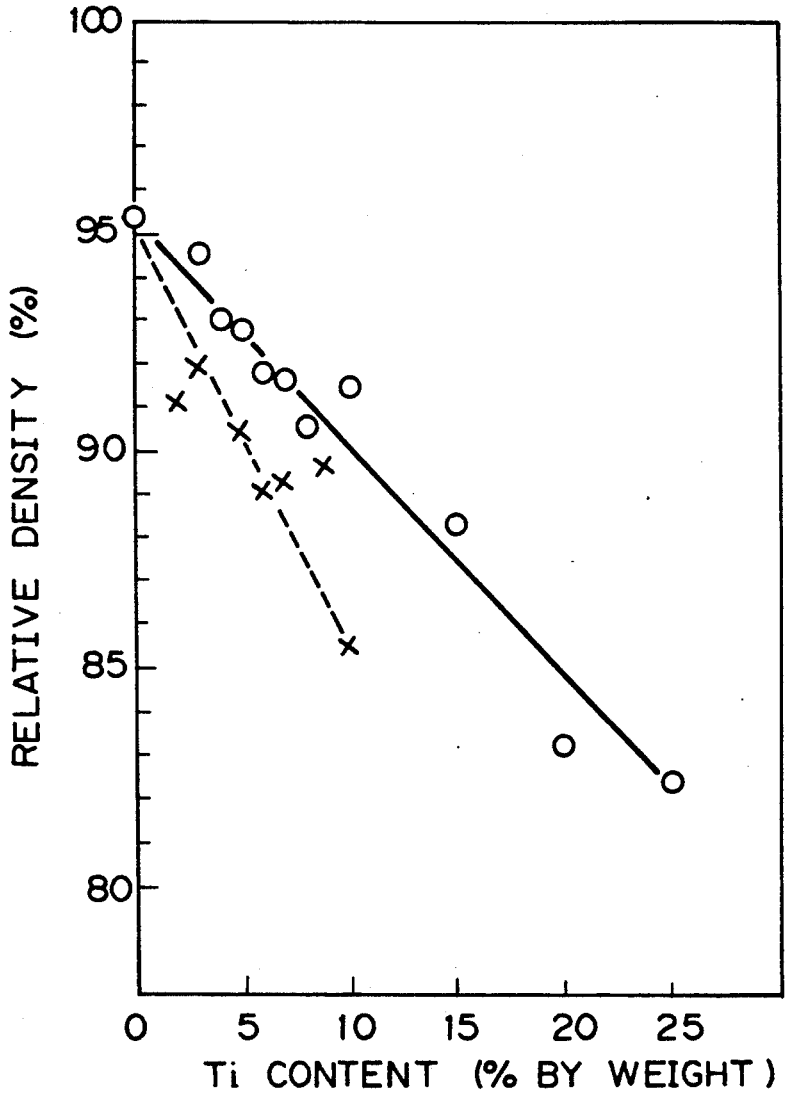
FIG. 2 is a graph illustrating a relationship between the Ti concentration and the relative density of the sintered product in FIG. 1.

The bending strength of the thus-produced sinter is shown in FIG. 1, while the relative density thereof is shown in FIG. 2. In FIGS. 1 and 2, the solid lines correspond to the sinter produced using the $TiH_2$ added, and the broken lines correspond to the sinter produced using the Ti powder added.

It can be seen from FIGS. 1 and 2 that the bending strength is increased, and the relative density is decreased, with increasing of the concentration of Ti up to about 20%. With the concentration of Ti of 20% or more, the liquid phase sintered product is increased in bending strength with increasing of the concentration, and the solid phase sintered product is gradually decreased in bending strength with increasing of the concentration. Therefore, when the concentration of Ti is of 20% or more, it is preferable to adopt the liquid phase sintering method in order to provide a higher bending strength. However, the solid phase sintered product also has a bending strength of 6 kg/mm$^2$ or more required for the bearing alloy and the like and hence, is sufficiently fit for practical use. Also, the addition of the powder of $TiH_2$ provided a higher strength sintered product than the addition of the powder of Ti.

Figure 3:
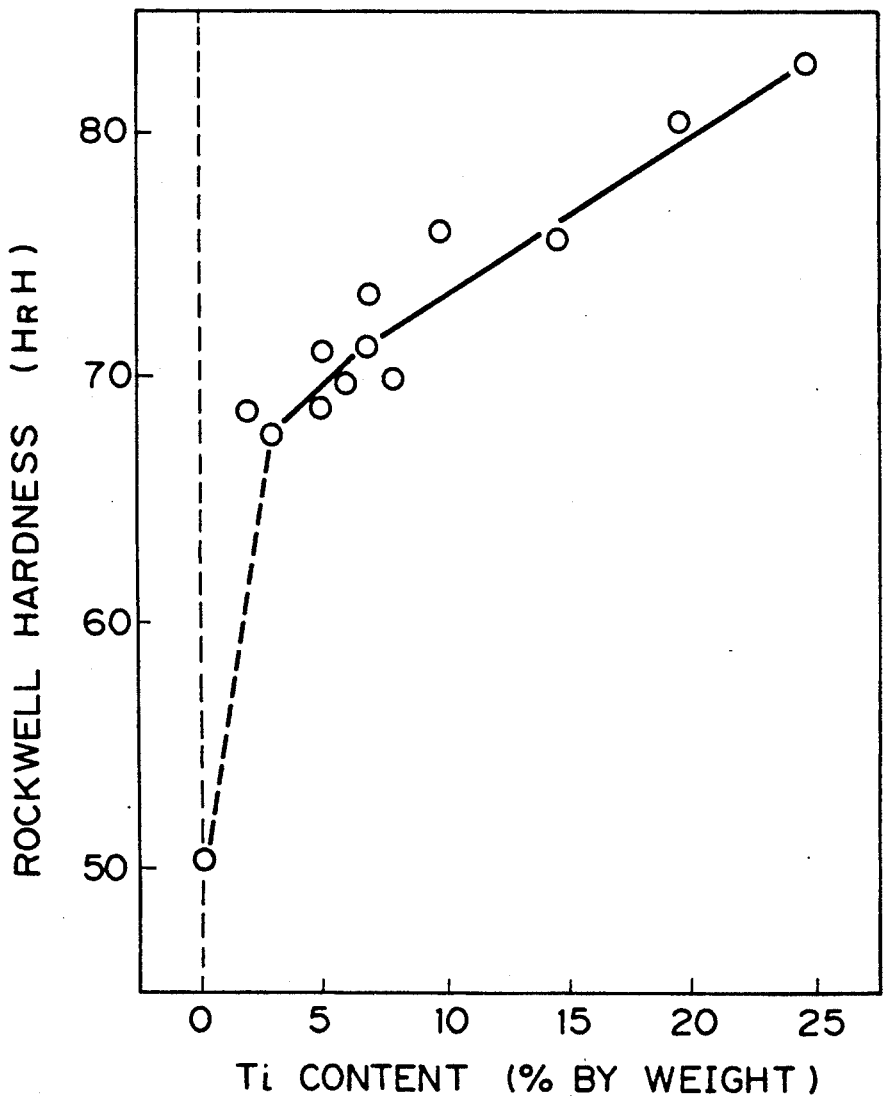
FIG. 3 is a graph illustrating a relationsip between the Ti concentration and the Rockwell hardness (H scale) of the sintered product in FIG. 1.
Figure 4A:
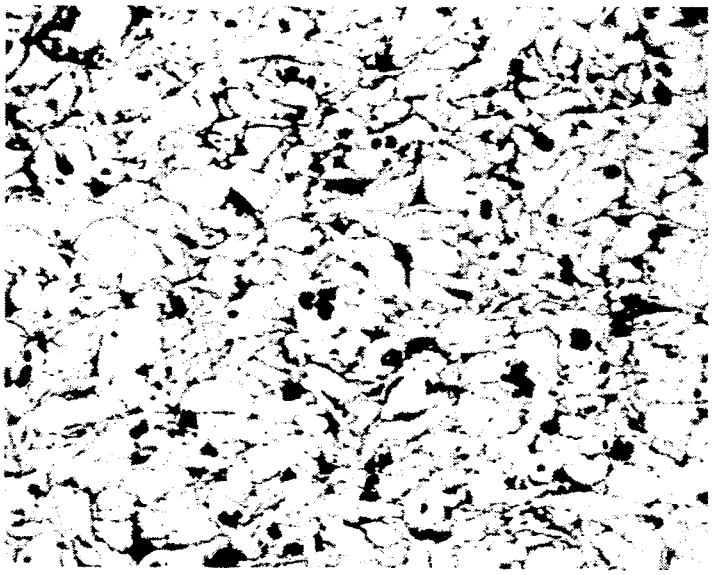
FIGS. 4(*a*) to (*f*) are 150-magnified microphotographs of the surface of the sintered product in FIG. 1 for illustrating the effect of the Ti concentration.
Figure 4B:
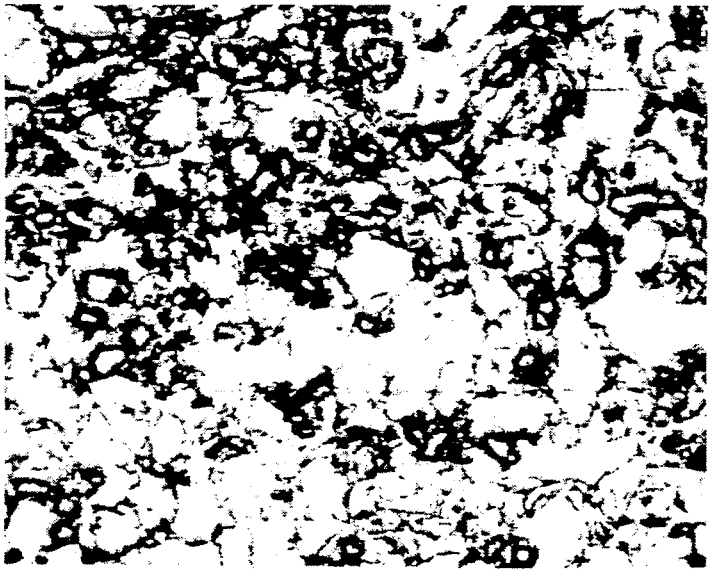
Figure 4C:
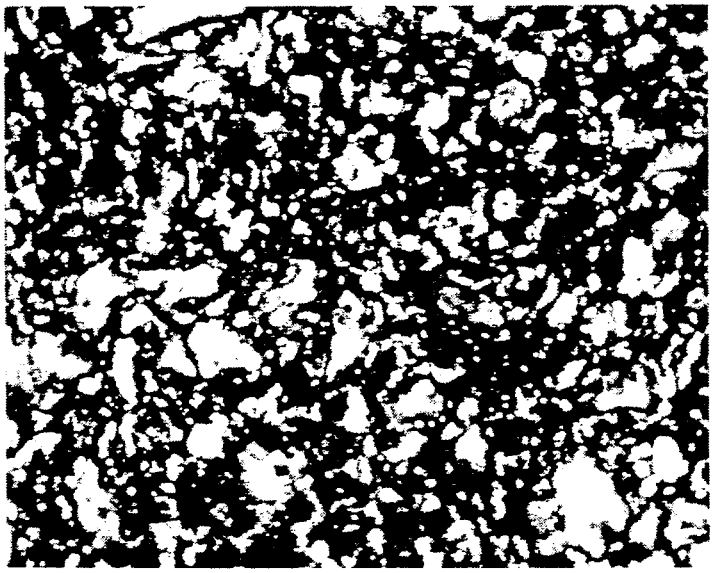
Figure 4D:
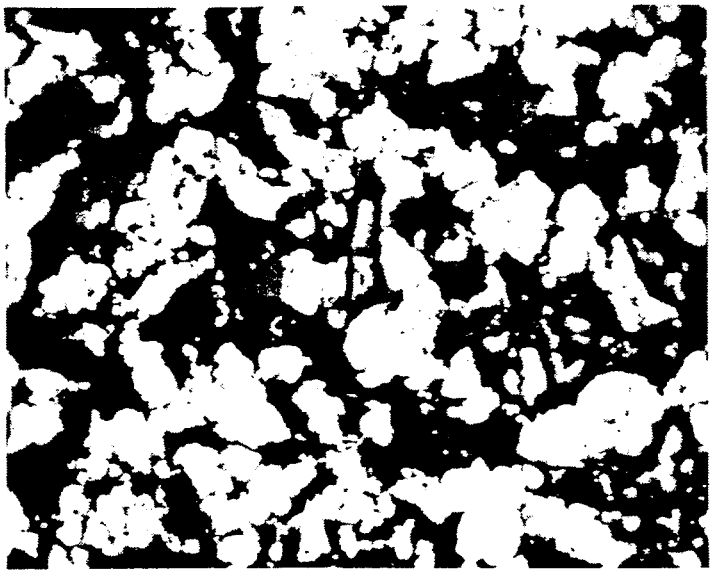
Figure 4E:
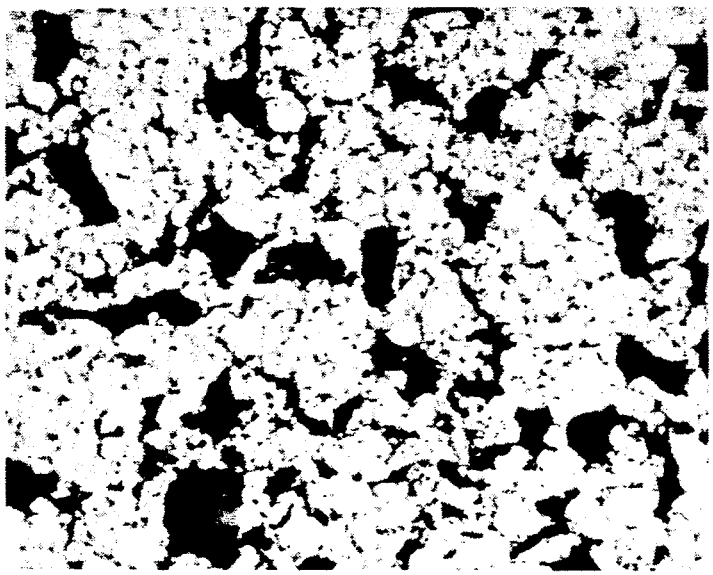
Figure 4F:
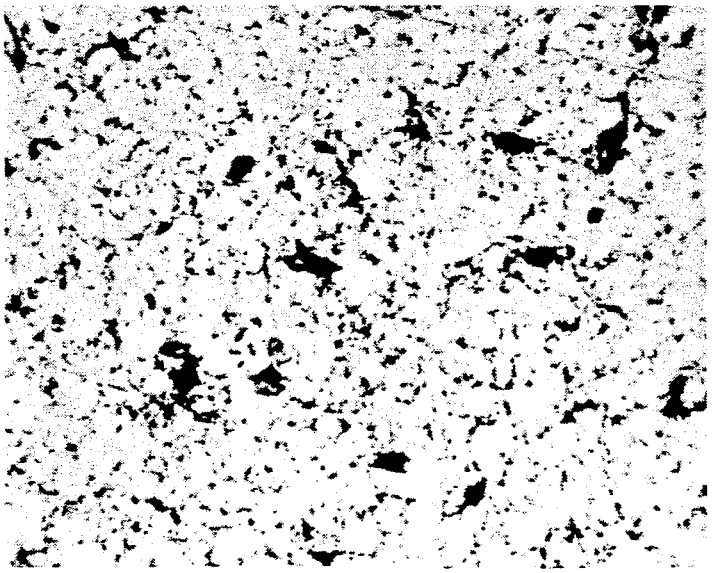

A relationship is shown in FIG. 3 between the Rockwell hardness of the Mg-Ti type alloy produced by using the addition of the powder of $TiH_2$ and a solid phase sintering method at a sintering temperature of 648° C. and the concenration of Ti.

150-Magnified microphotographs of the surfaces of a Mg sample and Mg-Ti type alloys are shown in FIGS. 4(*a*) to (*f*) for the purpose of illustrating the effect provided by the concentration of Ti. FIG. 4(*a*) is the microphotograph of the Mg sample sintered in a solid phase at 648° C. FIGS. 4(*b*) to (e) are the microphotographs of the Mg-Ti type alloys produced from the addition of $TiH_2$, respectively, and FIG. 4(*f*) is the microphotographs of the Mg-Ti type alloys produced by sintering in a solid phase at 700° C., wherein the concentrations of Ti in the Mg-Ti type alloys in FIGS. 4(*b*) to (*f*) are of 10%, 20%, 50%, 80% and 90%, respectively. In FIGS. 4(*a*) and (*b*), the white sections are Mg phase portions, and the black sections are micro-pore portions. In FIGS. 4(*c*) to (*f*), the white sections are Ti phase portions, and the black sections are Mg phase portions.

Figure 5:
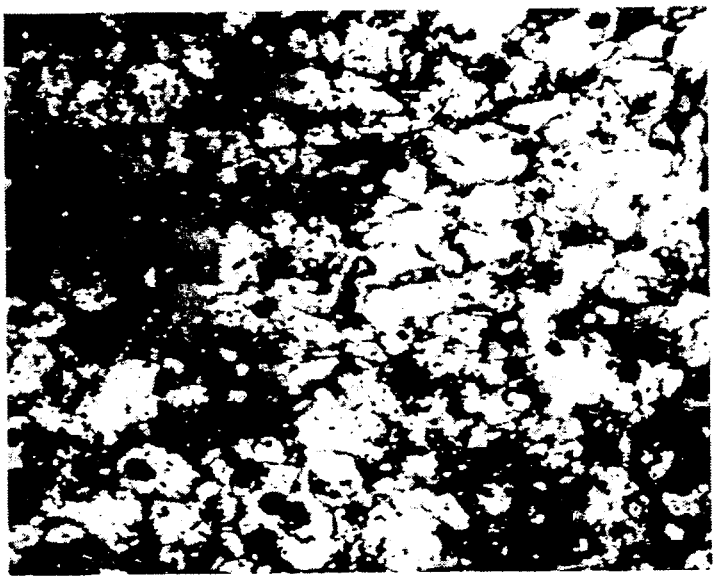
FIGS. 5(*a*), (*b*) and (*c*) are microphotographs of the surface of the sintered product in FIG. 1, similar to FIG. 4, for illustrating the effect of the sintering temperature.
Figure 5:
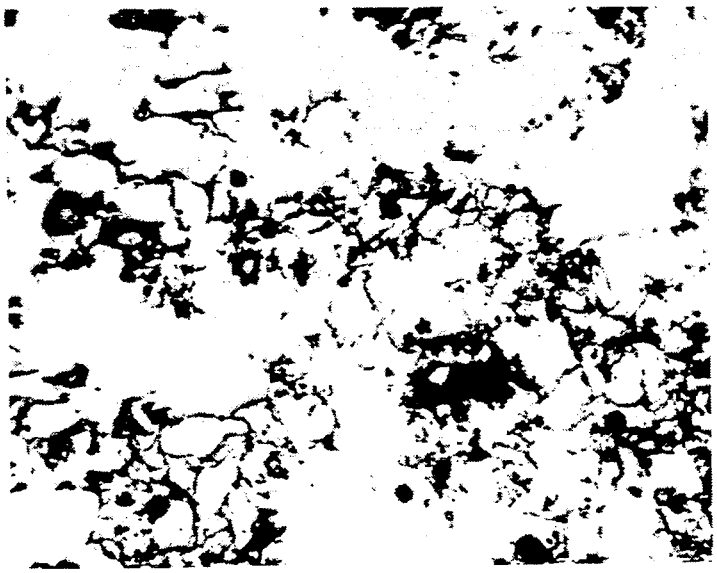
Figure 5:
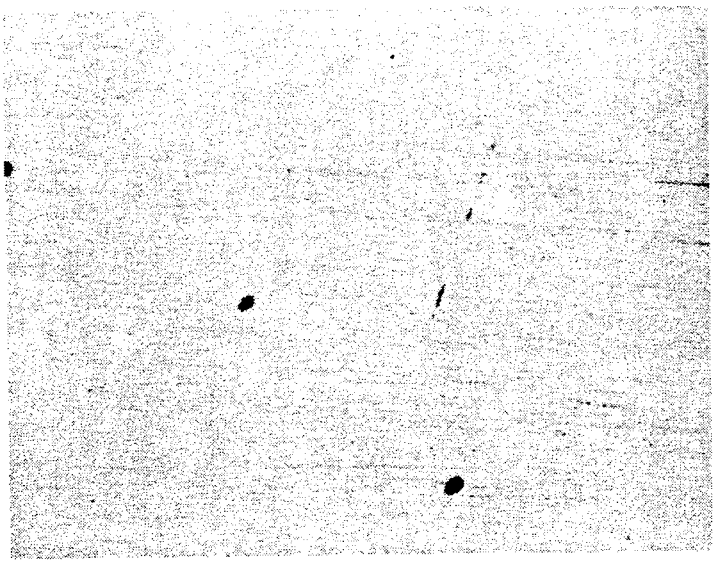
Figure 6:
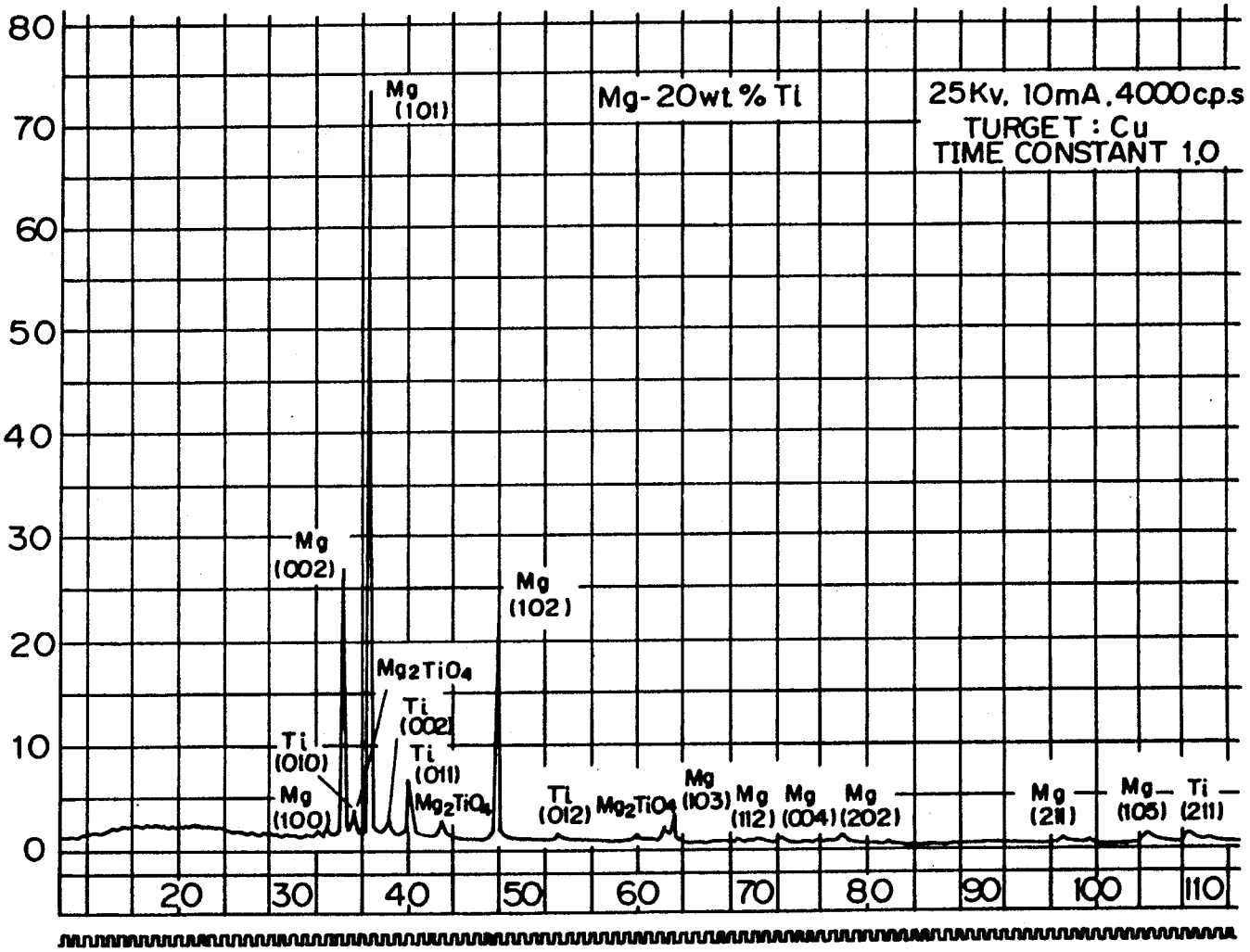
FIG. 6 is a chart of diffraction of X-rays for a Mg-Ti (20% by weight) alloy.

150-Magnified microphotographs of the surfaces of a Mg-Ti (7% by weight) type alloys are shown in FIGS. 5(*a*), (*b*) and (*c*) for the purpose of illustrating the effect of the sintering temperature. These alloys are products obtained from the addition of a powder of $TiH_2$, and FIG. 5 (*a*) corresponds to the alloy resulting from sintering in a solid phase at 645° C.; FIG. 5(*b*) to the alloy resulting from sintering in a liquid phase at 657° C., and FIG. 5(*c*) to the alloy resulting from sintering in a liquid phase at 660° C.

No failure of shape was observed in the sintered product resulting from sintering in the liquid phase and containing 50% or more of Ti.

EXAMPLE 2

Three types of samples of Mg-Ti type alloys were produced by adding a powder of $TiH_2$ having a particle size capable of passing through 325 meshes to a powder of Mg having a particle size capable of passing through 200 meshes, so that the Ti component in Mg-Ti type alloys provided after sintering may be of 10%, 20% and 50% by weight. The sintering was conducted in a hot press process, wherein using a mold, the mixture of the above powders was solid phase-sintered in an argon atmosphere with 30 kg/cm$^2$, at 648° C. for 10 minutes.

The bending strength of the thus-produced sinters were of 30 kg/mm$^2$ when the concentration of Ti was of 10% by weight; and 35 kg/mm$^2$ when the concentration of Ti was of 20% by weight; and 43 kg/mm$^2$ when the concentration of Ti was of 50% by weight, and it was found that such bending strength were larger than 25 kg/mm$^2$ of the bending strength of the sinter having the same concentration of Ti and produced in an ambient pressure sintering process. In addition, the relative density thereof was of 100%.

COMPARISON WITH THE PRIOR ART ALLOY

The comparison of the strength the corrosion resistance of the Mg-Ti type alloy in each of the above Examples with those of the prior art Mg-based and Al-based alloys is as follows:

(1) Comparison of the Strength

The Mg-based alloy cannot be compared, because those having the same proportion of concentration as in the present Examples were not produced.

The Al-based alloy has a maximum bending strength of 15 kg/mm$^2$, and the Al-Si (6 to 30% by weight) type alloy has a bending strength of 20 to 6 kg/mm$^2$.

The bending strength of the alloy produced in each of the above Examples is of 6 kg/mm$^2$ or more, and such alloy has a bending strength enough to satisfy 6 kg/mm$^2$ required, for example, for a bearing alloy. Moreover, a sinter having a bending strength larger than those of the various prior art a-loys is produced, if the concentration of Ti is of about 3% by weight or more, and the sintering temperature is near or more to the melting point of Mg.

(2) Comparison of Corrosion Resistance

The prior art Mg-based alloy is poor in corrosion resistance. This is because MgO which is a coating on the alloy is porous.

To the contrary, the Mg-Ti type alloy of the present invention is excellent in corrosion resistance, because the coating thereon was identified as a dense oxide film comprising $Mg_xTi_yO_{l-x-y}$ by an analysis by diffraction of X-rays as shown in FIG. 1.

(3) Comparison of Damping Capacity

Any of the various Mg-Ti type alloys in the present Examples has a damping capacity sufficiently larger than those of the prior art alloys.

It should be noted that the Mg-Ti type alloys in the present Examples showed a tendency to slightly decrease in damping capacity with increasing of the concentration of Ti.

(4) Comparison of Wear Resistance (Hardness)

Among the prior art Al-Si based alloys employed as a wear-resistant material for a vane of a vane pump and the like, the best Al-Si (20% by weight)-Cu (1% by weight-Ni (2% by weight) type alloy has a Rockwell hardness of 63 to 80 (HrH) and is excellent in wear resistance.

The following is the description of the production of a Mg-Ti type alloy formed into any shape.

This process may be carried out by a method similar to one comprising an extrusion combined with a die cast molding.

First, a powder of Mg, a powder of Ti and/or a powder of $TiH_2$ are compounded and mixed under the same conditions as in the above-described sintering.

The resulting mixture is heated up to a temperature higher than the melting point of Mg and pressurized while being axially transferred by a transferring device such as a screw conveyor to give a molten mixture containing the Ti and/or $TiH_2$ powder(s) mixed in the molten Mg. Then, the molten mixture is pressurized and poured into a cavity within a mold, and thereafter cooled to produce a Mg-Ti type alloy.

In this Example, the mixture is poured into and molded in the mold under a temperature condition similar to a liquid phase condition in the sintering process.

If the interior of the mold is evacuated, it is possible to remove an unnecessary gas produced for a period from the completion of the pouring to the completion of the cooling.

The cooling of the interior of the mold may be slow or rapid. Alternatively, the molten material may be rapidly cooled in a predetermined vacuum down to a temperature lower than the melting point (e.g., 380° C: $10^{-3}$ torr) of Mg in such degree of vacuum (e.g., any point in a range of temperatures decreased by about 100° C. to 300° C. from such melting point); maintained at that temperature for a predetermined period of time, and then rapidly cooled again.

The Mg-Ti type alloys formed in this manner have excellent in properties, as those in the above Examples. It also has an easy forming property permitting formation into any shape and hence, can be utilized for production of a material in various industrial fields.

The present invention is intended to be limited to the above-described Examples, and it will be understood that modifications and variations can be made as required.

The producing process of the present invention can be used to produce a Mg-based alloy, wherein an alloy element having a lower solubility to Mg like Ti is also added at a high concentration as in the above embodiment of the present invention. Such alloy elements include Zr, Be, Si, V, Cr, Mn, Fe, Co, Ni, Cu, Ge, Sr, Zr, Nb, Mo, Sb, Te, Ba, Hf, W, Ir, Au, La, Ce, Pr, Nd, Gd, U, etc., which may be in the form of a simple powder or a hydride powder.

What is claimed is:

1. A process for producing a Mg-Ti type alloy, comprising the steps of:

compounding and mixing at least one of a powder of Ti and a powder of titanium hydride with a powder of Mg, so that the Ti composition in the final product may be in a range of 0.04 to 99.96% by weight;

transferring the resulting mixture along a transfer path while heating and pressurizing it to melt Mg, pouring the molten mixture containing at least one of the Ti powder and the titanium hydride powder incorporated in the molten Mg into a forming mold; and cooling the mixture.

2. A process for producing such a Mg-Ti type alloy according to claim 1, wherein interior of the mold is evacuated before pouring the molten mixture.

3. A process for producing a Mg-Ti alloy, comprising the steps of:

compounding and mixing in either a dry manner or in a wet manner at least one of a powder of Ti and a powder of titanium hydride with a powder of Mg, so that the Ti composition in a sintered product may be a range of 0.04% to 99.96% by weight;

forming the resulting mixture into a shape by a compression molding under a pressure of 0.1 to 5 tons/cm$^2$, and sintering the formed material at a temperature in a range of 300° to 800° C. from a solid phase to a liquid phase point in an inert atmosphere or in a vacuum under a pressure of 0 to 600 kg/cm$^2$.

* * * * *